United States Patent [19]

Guida

[11] 4,013,084

[45] Mar. 22, 1977

[54] MAGNA COMB

[76] Inventor: Joseph Guida, 287 Sycamore Lane, South Hauppauge, N.Y. 11722

[22] Filed: Feb. 6, 1976

[21] Appl. No.: 655,828

[52] U.S. Cl. ..... 132/11 R

[51] Int. Cl.[2] ..... A45D 24/00

[58] Field of Search ..... 132/11 R; 248/206; 206/350, 818

[56] References Cited

UNITED STATES PATENTS

| | | | |
|---|---|---|---|
| 2,297,806 | 10/1942 | Smith | 206/818 |
| 2,385,859 | 10/1945 | Jacobson | 24/201 B |
| 2,414,653 | 1/1947 | Lookholder | 24/201 B |
| 2,608,979 | 9/1952 | Martino | 132/147 |

*Primary Examiner*—G.E. McNeill

[57] ABSTRACT

A pocket comb that is designed having a permanent magnet inserted along the comb backbone, so that the comb can be readily and easily attached to any steel surface, such as the inner side of a medicine cabinet door, a steel locker for use in a school or at work, or under a dashboard of an automobile, so that the comb is thus always handy without the necessity of looking for the same.

1 Claim, 6 Drawing Figures

MAGNA COMB

This invention relates generally to hair combs.

A principal object of the present invention is to provide a magna-comb which includes a permanent magnet installed thereinto, so that the comb can be readily supported from any steel surface.

Another object of the present invention is to provide a magna-comb, which, accordingly, can be supported from an inner side of a medicine cabinet door, horizontally on top of a sliding door cabinet, a locker such as used in schools or at work, or under a dashboard of an automotive vehicle.

Yet another object is to provide a magna-comb which, accordingly, saves on space by being readily attachable to a metal surface so that it does not require any shelf or receptable to hold the same.

Still another object is to provide a magna-comb which thus also is a time saver, because the comb thus does not fall off any shelf or fall out of any tray, thus eliminating the necessity of looking for the fallen comb, such as occurs with conventional combs.

Still another object is to provide a magna-comb, which, accordingly, does not require to be stored in a glove compartment of an automotive vehicle where it becomes lost and confused with other articles that are jammed thereinto.

Other objects are to provide a magna-comb which is simple in design, inexpensive to manufacture, rugged in construction, easy to use and efficient in operation.

These and other objects will be readily evident upon a study of the following specification and accompanying drawing, wherein.

Figure 1:
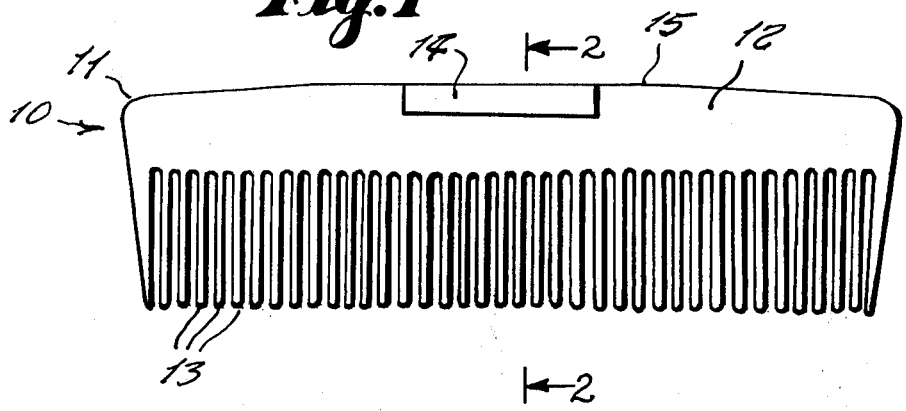
FIG. 1 is a side elevation view of the present invention.
Figure 2:
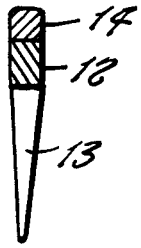
FIG. 2 is a cross-sectional view taken on line 2—2 of FIG. 1.
Figure 3:
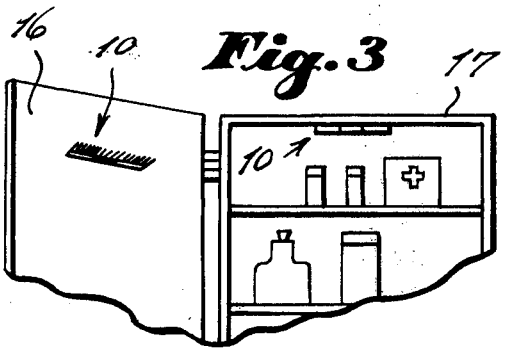
FIG. 3 is a fragmentary view of a medicine chest showing the present invention attached upon the inner side of a medicine chest door.
Figure 4:
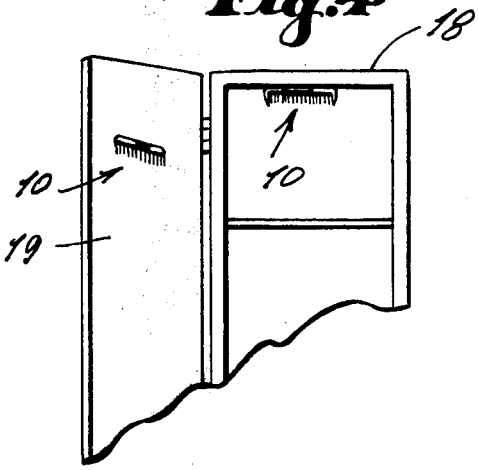
FIG. 4 shows the present invention attached inside a locker.
Figure 5:
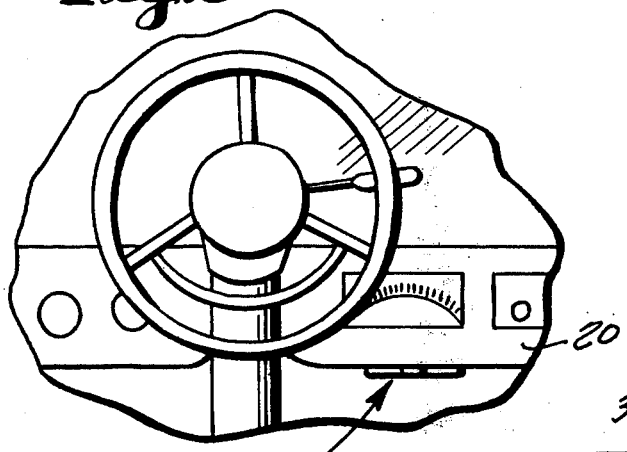
FIG. 5 shows the invention attached under a car dashboard.

Referring now to the drawing in greater detail, and more particularly to FIGS. 1 through 5 thereof at this time, and reference numeral 10 represents a magna-comb, according to the present invention, wherein there is a comb body 11 made of plastic material and which includes a longitudinally extending backbone 12 which is integral with a row of teeth 13 extending from one edge of the backbone 12.

In the present invention, a permanent magnet 14 is inserted into the backbone 12, the magnet being flush with an edge 15 of the backbone, and being located along the longitudinal center portion thereof, as shown in FIG. 1.

In operative use, it is now evident that the magna-comb thus made can be readily magnetically supported from any steel surface, such as is found upon a door 16 of a medicine chest 17, an inner side of a locker 18 or inner side of a locker door 19, as well as under a lower edge of an automobile dashboard 20. Thus the magna-comb can be quickly and easily stored away, without mixing it up with other articles placed in a drawer or glove compartment.

Figure 6:
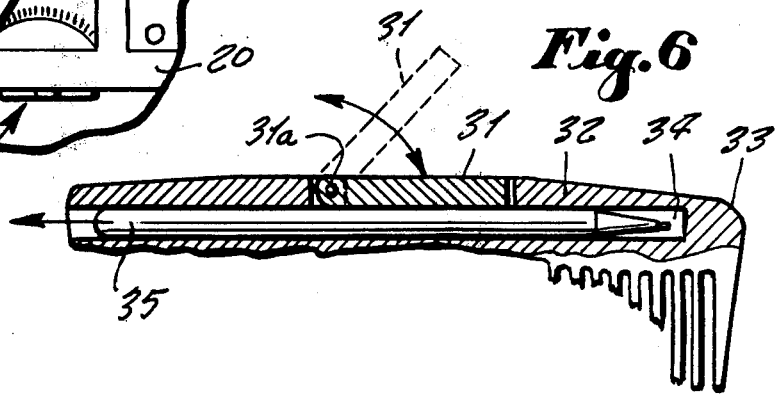
FIG. 6 is a side cross-sectional view of a modified design of the invention, which additionally includes a handy writing implement retained within the comb by the magnets.

Reference is now made to FIG. 6 of the drawing wherein there is shown a modified design of magna-comb 30, and wherein the permanent magnet 31 is not rigidly inserted within the backbone 32 of the comb body 33, but is attached pivotally therein, by means of a pin 31*a* transversely through one end of the magnet. Thus the magnet is pivotable between the position shown in solid lines, and the position shown in the dotted lines.

In this form of the invention there is additionally provided an elongated opening 34 inside the backbone 32, the opening 34 extending from one end of the backbone, so that a writing implement 35, such as a ball point pen or pencil, can be readily stored within the interior of the comb so that the writing implement is always handy when needed. Such writing implement preferably is of the type that has a metal shell, preferably of steel, so that when it is inside the opening 34, and the magnet is closed thereagainst, the magnet will prevent the writing implement from accidentally to slide outwardly thereform. However, when a person desires to remove the writing implement, he needs then only to simply pivot the magnet upwardly to the position shown by the dotted lines whereby the magnetic attraction against the steel case of the writing implement is thus released so that the writing implement then easily drops out of the opening 34.

It is to be noted that the writing implement also serves to keep the magnet in the closed position inside the comb backbone, due to the magnetic attraction of the magnet and the steel of the writing implement case, so that in the closed position, the magnet can then be magnetically adhered to any supporting surface such as dashboard, locker or medicine cabinet door and the like.

Thus a modified design of the invention is provided.

While various changes may be made in the detail construction, it is understood that such changes will be within the spirit and scope of the present invention as is defined by the appended claims.

What I now claim is:

1. In a magna-comb, the combination of a comb body made of a plastic material, said comb body including a longitudinally extending backbone having a plurality of teeth along one edge thereof formed in a row, and said backbone supporting a permanent magnet therein, said magnet being pivotally attached to said backbone by means of a transverse pin through one end of said magnet, said magnet being pivotable outwardly from within said backbone, said backbone including a longitudinally extending opening slideably receiving a writing implement such as a ball point pen or pencil, said writing implement having a case made of steel, said magnet being pivotable against a side of said writing implement, said magnet being positioned so that when pivoted into said backbone then one side of said magnet is flush with a longitudinal side edge of said backbone for holding against any exterior steel surface and at a same time an opposite parallel side of said magnet engages a side of said steel cased writing implement, said opposite side in said pivoted position being aligned accordingly with a side of said opening, said writing implement being longer than said magnet, so that opposite ends of said writing implement prevent transverse shift of said writing implement, so that said writing implement thus retains said magnet in said position within said backbone.

* * * * *